US005613310A

United States Patent [19]

Jimenez et al.

[11] Patent Number: 5,613,310

[45] Date of Patent: Mar. 25, 1997

[54] EDGE SHAPE IN A SMOOTHING IRON

[75] Inventors: Miguel Jimenez, Molins de Rei; Miguel Vazquez, Barcelona; Francesc Carreras, Sant Just Desvern; Juan C. Coronado, Barcelona; Augustin Auria, Isidro Marti, all of Spain; Andrea Hahnewald, Dreieich; Rolf Eimecke, Oberursel, both of Germany

[73] Assignee: Braun Aktiengesellschaft, Kronberg, Germany

[21] Appl. No.: 450,306

[22] Filed: May 25, 1995

[30] Foreign Application Priority Data

Jun. 24, 1994 [DE] Germany ..... 44 22 090.1

[51] Int. Cl.[6] ..... D06F 75/38

[52] U.S. Cl. ..... 38/93

[58] Field of Search ..... 38/74, 80, 81, 38/93, 97, 77.5, 77.8, 77.83

[56] References Cited

U.S. PATENT DOCUMENTS

| | | | |
|---|---|---|---|
| 1,749,597 | 3/1930 | McArdle | 38/88 |
| 2,142,032 | 12/1938 | Matsen | 38/97 |
| 2,257,451 | 9/1941 | Barnes | 38/93 X |
| 2,846,793 | 8/1958 | Studer | 38/93 X |
| 4,209,921 | 7/1980 | Kochauf | 38/97 |
| 4,658,520 | 4/1987 | Henneberger et al. | 38/93 |
| 4,837,952 | 6/1989 | Henney et al. | 38/77.83 X |

FOREIGN PATENT DOCUMENTS

| | | | |
|---|---|---|---|
| 1123027 | 9/1956 | France . | |
| 620449 | 10/1935 | Germany . | |
| 1963617 | 9/1962 | Germany . | |
| 7616425 | 5/1976 | Germany . | |
| 4316281 | 11/1994 | Germany | 38/93 |

*Primary Examiner*—Ismael Izaguirre
*Attorney, Agent, or Firm*—Fish & Richardson, P.C.

[57] ABSTRACT

The invention is directed to a smoothing iron having an approximately triangular metal soleplate including a sliding surface 4 and an edge area 6 encircling the sliding surface and overlapping it partially. The edge area 6 is bent in an upward and inward direction at an angle of 35°, maximum, relative to the sliding surface 4. At the tips of the triangle, the edge area includes a slot 8 formed by the side edges of a notch cut in the blanked metal soleplate. The edge area is angled by a forming operation involving several steps.

9 Claims, 2 Drawing Sheets

EDGE SHAPE IN A SMOOTHING IRON

BACKGROUND OF THE INVENTION

The metal soleplate is connected with the heating means, conventionally a metal shoe of a material conducting heat well as, for example, an aluminum casting. Positive engagement between the metal soleplate and the metal shoe is accomplished in a first process involving placement of a blanked metal soleplate under the metal shoe, to be subsequently bent over the shoe. In this process, the sliding surface terminates in a radiused configuration. In the ironing surface which is conventionally of approximately triangular shade, with the forward tip of the triangle being used for the ironing of narrow sections, such as around buttons, ruching, piping, etc., it is important for the forward tip as well as the rear ends of the ironing surface to ensure a perfect and gentle smoothing action. However, the radiused boundaries of the sliding surface produce a steed slope from the sliding surface to the housing which prevents narrow sections from being ironed satisfactorily. In addition, the bending operation of the soleplate results in scores and wrinkles at the forward tip and the rear corners of the metal soleplate, because the edge area is under severe compressive stresses at the forward tip and the corners. Creases or buttons tend to get caught in the scores, resulting in damage to the article being ironed.

According to a second process, scoring and wrinkling can be avoided by selecting a still steeper slope of the edge area in the pointed ends of the metal soleplate, as a result of which the material in the edge area is not exposed to such severe compressive stresses during the bending operation. However, when ironing narrow sections, the steeper edge area restricts the radius of the sliding surface to a substantially larger extent. The ironing of narrow sections such as button rows, laces and ruching is thus a very difficult task.

It is therefore an object of the present invention to provide a smoothing iron with a metal soleplate which ensures an improved ironing of narrow sections.

SUMMARY OF THE INVENTION

In a smoothing iron according to one aspect of the invention, the area covered by the sliding surface is particularly large because the edge area extends at a particularly flat angle limited to 35°, maximum. This flat extension of the edge area does not, however, incur the customary disadvantage of severe compression of the material of the metal soleplate. Such compression of the material is advantageously avoided or reduced in that a notch is cut in the edge area at each corner of the sliding surface. After the bending operation, the side edges bounding the notch adjoin each other directly, so that the outer surface of the edge area is largely smooth and free from scores. Because compression is avoided or reduced, a further advantage resides in that the flat angle of the edge area is maintained also in the corners of the sliding surface.

The iron has a particularly smooth surface.

The metal soleplate of the present invention may be provided with minimum radii at the pointed ends of the sliding surface because there is no projecting material to be compressed. Such minimum radii facilitate in particular the performance of difficult ironing tasks as the ironing of laces, ruching and button rows.

The particularly flat angle between the edge area and the sliding surface further affords the advantage of resulting in an esthetically appealing transition between the housing and the metal soleplate. In cases where the angles are steeper, the resulting slot permitting in part an unobstructed view of the housing interior is not desirable also for safety considerations.

The metal soleplate of the present invention may be made of aluminum or, alternatively, of steel sheet. In addition, the possibility exists to coat the metal soleplate. The coating may be applied prior or subsequent to the forming of the metal soleplate.

The soleplate of the present invention preferably is manufactured from a blank formed to the desired shade in one or several consecutive processing devices. The blank includes a sliding surface and an edge area adjoining the boundary line of the sliding surface. A notch is provided in the edge area in at least one pointed end. In the processing device which, for example, is a transfer press known in the art, the edge area of the blank is bent to an angle of 35°, maximum, relative to the sliding surface in at least two consecutive processing steps. As this occurs, the side edges bounding the notch are brought into direct abutting engagement. The method of the present invention affords particular ease and economy of manufacture of the metal soleplate.

By virtue of the provision of the notches, the thickening of material in the area of the acute angles of the boundary line of the sliding surface is avoided in an advantageous manner. It is thereby possible to bend the edge area of the smoothing iron soleplate at an acuter angle and, hence, to increase the area covered by the sliding surface of the iron.

The method advantageously avoids the thickening of stock in the area of the acute angles during bending of the edge area entirely. By giving the slot a suitable subsequent treatment, the side edges can be caused to merge into each other so that a smooth surface results.

In a further advantageous feature of the method, the notch does not extend fully up to the boundary line of the sliding surface. While thickening of stock will then occur during bending of the edge area, such excess stock can be beaten into the area of the notch by a suitable operation as, for example, hammering or the like. This enables the resulting thickening of material to be eliminated with little effort, part of this material being caused to flow into the slot. A smooth surface is thus obtained.

According to a further preferred method, the blank undergoes further processing subsequent to the forming operation. After bending of the edge area, the slot formed by the adjoining side edges of the notch at the pointed ends of the metal soleplate is processed in such fashion that the side edges merge into each other. This produces a well-closed outer surface of the edge area.

The metal soleplate of the present invention will be explained in more detail in the following with reference to an embodiment.

DESCRIPTION OF PARTICULAR EMBODIMENTS

Figure 1:
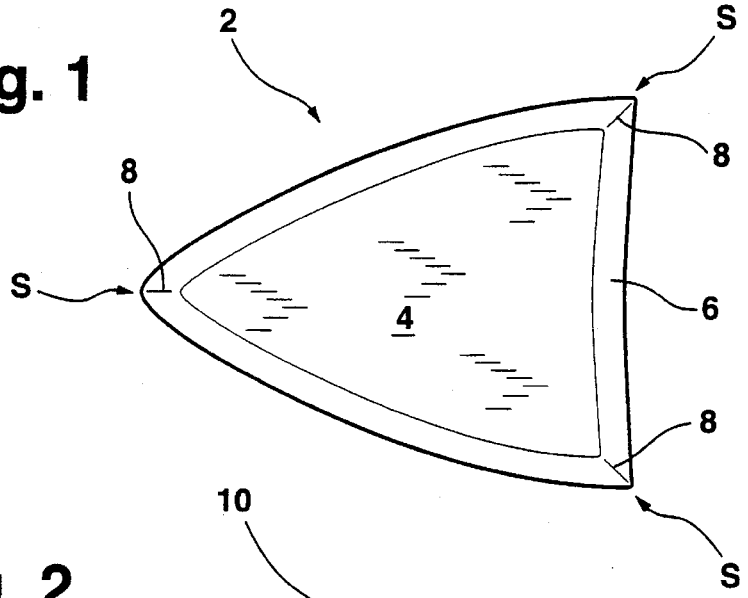
FIG. 1 is a top plan view of a metal soleplate.

FIG. 1 shows a metal soleplate 2 made of aluminum which is of an approximately triangular configuration. The soleplate 2 is composed of a sliding surface 4 and an edge area 6. The edge area 6 encircles the sliding surface 4 completely, overlapping part of the outer region of the sliding surface 4. At each of its pointed ends "S", the edge area has a slot 8 which, following an operation subsequent to the forming of the soleplate, is however not visible on the outer surface of the edge area 6.

Figure 2:
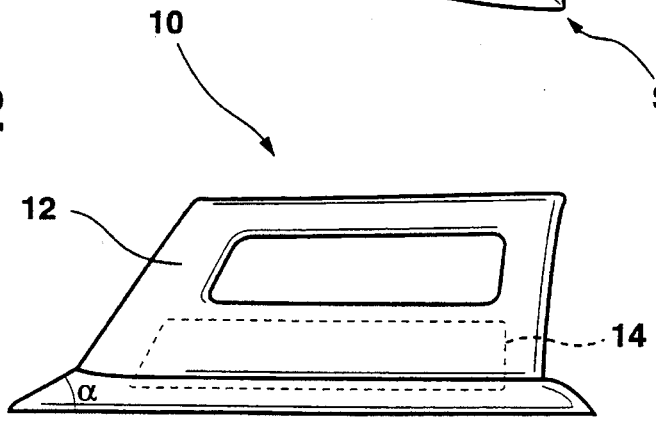
FIG. 2 is a diagrammatic side view of a smoothing iron.

FIG. 2 shows a smoothing iron 10 having a housing 12 in which means for heating the sliding surface 4 are arranged. The means 14 (indicated in broken lines in FIG. 2) are configured as an aluminum heating block joined to the metal soleplate by adhesive bonding. The smoothing iron may be a simple electric flatiron or, alternatively, a steam iron. As becomes apparent from FIG. 2, the edge area 6 is bent at an angle $\alpha$ relative to the sliding surface 4. The angle $\alpha$ is preferably smaller than 30°, but not larger than 35°.

Figure 3:
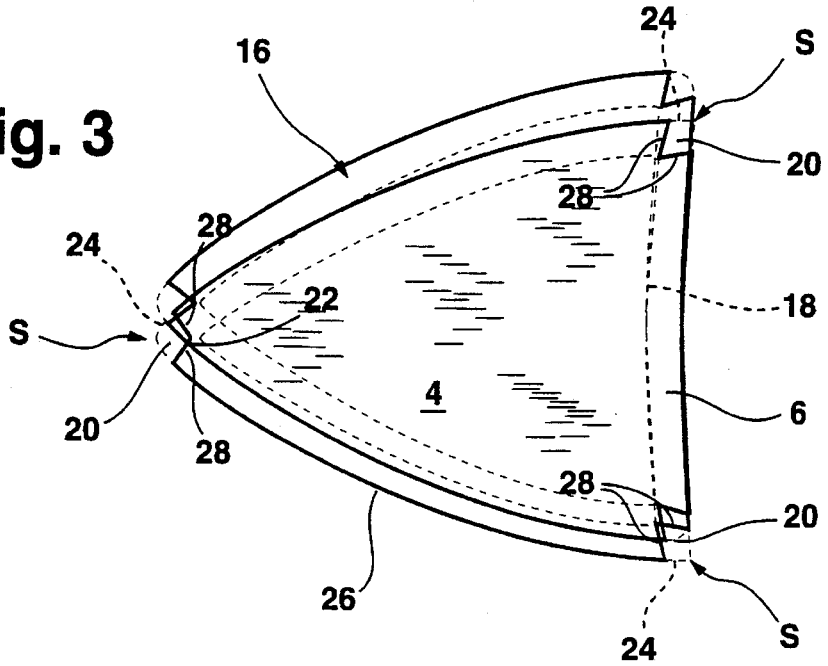
FIG. 3 is a top plan view of a blanked metal soleplate.

FIG. 3 shows a blank 16 for a metal soleplate 2. It is approximately triangular in plan view. The edge area 6 adjoins the boundary line 18 of the sliding surface 4. A notch 20 of an approximately triangular configuration is provided in each of the pointed ends S of the blank. A tip of the notch 20 extends up to the boundary line 18, and a base line 24 coincides approximately with the peripheral edge 26 of the edge area 6. The side edges 28 of the notch 20 provide the slot 8 when the soleplate 2 is in finished condition (see FIG. 1). The angle included between the two side edges 28 is determined by the angle $\alpha$. The flatter the angle $\alpha$, the larger the angle between the side edges 28.

Figure 4:
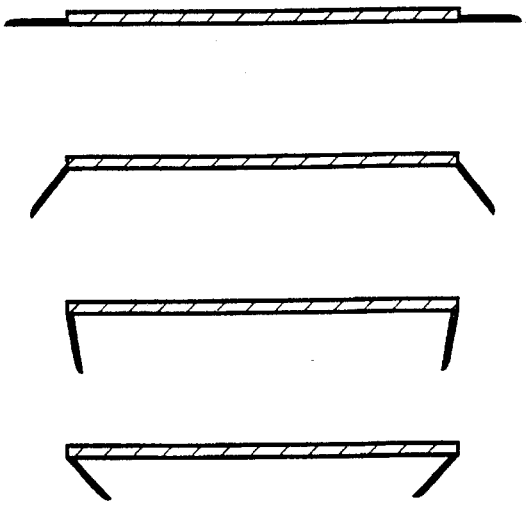
FIG. 4 is a diagrammatic sequence of bending operations of a blank.

The metal soleplate is manufactured from the blank illustrated in FIG. 3 by cutting out the notches 20 first. Then the edge area 6 is bent about the circumference of the sliding surface 4 in a transfer press involving several consecutive operations as illustrated schematically in FIG. 4. On completion of the last operation, the edge area 6 is at an angle of about 30° to the sliding surface 4, the side edges 28 of the notch 20 then forming the slot 8. Subsequent to the bending of the edge area 6, the slots 8 undergo a mechanical treatment causing the side edges 28 to merge into each other on the outer surface of the edge area 6, making the slot invisible. This mechanical treatment may be accomplished by plastic deformation as, for example, hammering or a similar operation. With this method, a metal soleplate for a smoothing iron is manufactured whose edge area 6 is bent at an angle of about 30° relative to the sliding surface 4, with the outer surface of the edge area 6 being completely smooth and plane.

In the process, the soleplate 2 advantageously contacts a shoe (not shown) of a smoothing iron such that both the sliding surface 4 and the edge area 6 are in a heat-conducting relationship with the shoe of the smoothing iron.

Figure 5:
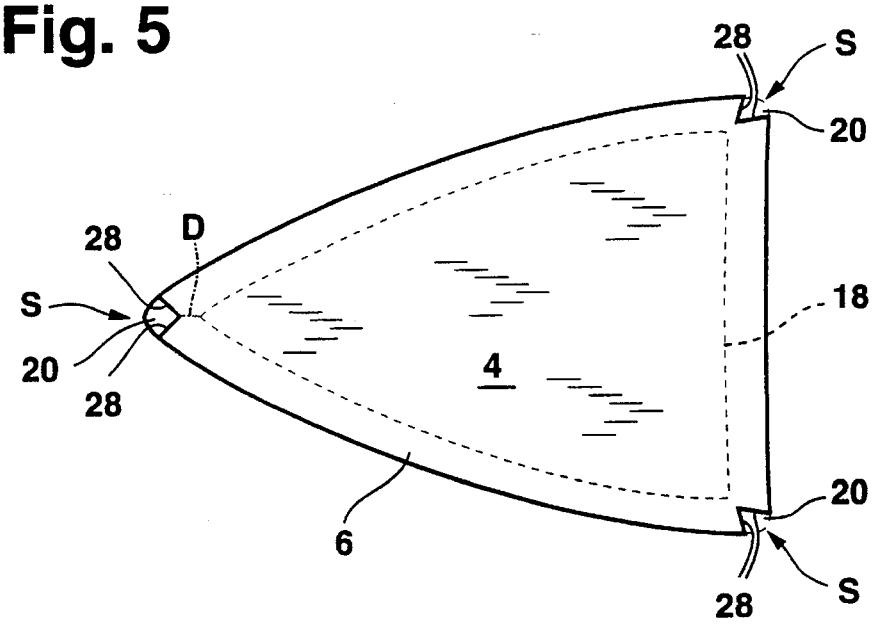
FIG. 5 is a top plan view of another blanked metal soleplate.
Figure 6:
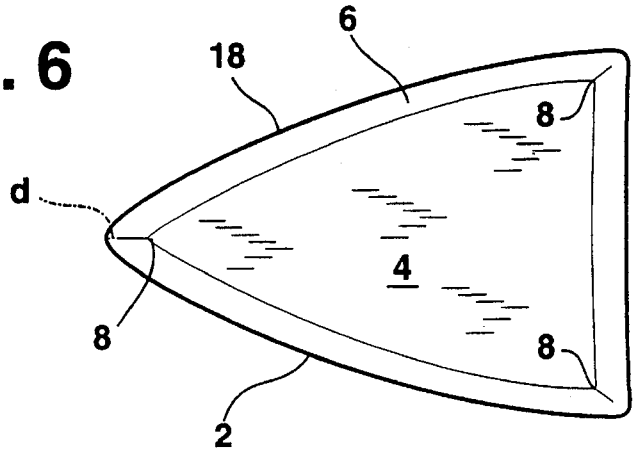
FIG. 6 is a top plan view of a metal soleplate.

FIG. 5 shows a top plan view of another blank. FIG. 5 differs from FIG. 3 in that the notches 20 provided at the pointed ends S do not extend up to the boundary line 18 of the sliding surface 4. In the bending operation of the edge area 6, thickening of material will again occur at the pointed ends S. However, this thickening of stock is less severe than it would be if the notches 20 were omitted. By a suitable mechanical process such as hammering or the like, it is further possible to treat this thickening such that the material is caused to flow into the resulting slot 8 according to FIG. 6. By reason of the fact that part of the excess stock resulting from the thickening is allowed to flow into the slot 8, it is possible to obtain again a smooth outer surface in the edge area. In contrast to the embodiment of FIGS. 3 and 1, it shows in the embodiment of FIGS. 5 and 6 that no slot occurs precisely in the area of the boundary line of the sliding surface in the immediate proximity of the pointed end and, hence, that in this area the outer surface is of a particularly smooth and score-free configuration.

What is claimed is:

1. A smoothing iron with a shoe, a soleplate in heat exchange relation with said shoe, said soleplate having a planar sliding surface and an upwardly and inwardly bent edge area at the boundary line of said sliding surface, said soleplate having a pointed end and a slot at said pointed end, side edges which bound said slot adjoining each other directly, said slot being spaced from said boundary line of said sliding surface.

2. The smoothing iron of claim 1 wherein said soleplate is of aluminum.

3. The smoothing iron of claim 1 wherein said soleplate is of sheet steel.

4. The smoothing iron of claim 3 wherein said soleplate is coated.

5. The smoothing iron of claim 1 wherein said edge area of said soleplate is angled at an angle no greater than 35 degrees relative to said sliding surface adjacent said slot.

6. A method of manufacturing a soleplate for use in a smoothing iron comprising the steps of providing a metal blank with a pointed end, an edge area adjoining said boundary line of said sliding surface and including a notch at said pointed end, said notch having side edges that are spaced from one another, bending said edge area in at least two consecutive operations to an angle no greater than 35 degrees relative to said sliding surface, said bending operation causing said side edges of said notch to be brought into direct abutting engagement.

7. The method of claim 6 wherein said notch has a tip that extends up to the immediate proximity of said boundary line of said sliding surface, and further including the step of cutting out said notch prior to said bending operations.

8. The method of claim 6 and further including the step of cutting out said notch at said pointed end prior to said bending operations, said notch having a tip at a distance (d) to said boundary line of said sliding surface.

9. The method of claim 8, and further including the step of processing said edge area after said bending operation such that said abutting side edges merge into each other.

* * * * *

UNITED STATES PATENT AND TRADEMARK OFFICE

CERTIFICATE OF CORRECTION

PATENT NO. : 5,613,310

DATED : March 25, 1997

INVENTOR(S) : Miguel Jimenez, Miguel Vazquez, Francesc Carreras, Juan C. Coronado, Augustin Auria, Andrea Hahnewald, Rolf Eimecke It is certified that error appears in the above-identified patent and that said Letters Patent is hereby corrected as shown below:

Col. 1, l. 2, insert the following --This invention relates to a smoothing iron.--

Col. 1, l. 19 "steed" should be --steep--.

Col. 1, l. 57, insert --preferably-- after "iron".

Col. 2, l. 11, "shade" should be --shape--.

Signed and Sealed this

Twentieth Day of April, 1999

*Attest:*

Q. TODD DICKINSON

*Attesting Officer*

*Acting Commissioner of Patents and Trademarks*